United States Patent [19]

Taylor

[11] 4,288,231

[45] Sep. 8, 1981

[54] COAL TREATMENT PROCESS

[75] Inventor: David W. Taylor, Edgemont, Pa.

[73] Assignee: Microfuels, Inc., Haverford, Pa.

[21] Appl. No.: 93,870

[22] Filed: Nov. 13, 1979

[51] Int. Cl.[3] ..... C10L 9/00; C10L 9/08; B02C 19/06

[52] U.S. Cl. ..... 44/1 SR; 44/1 R; 44/2; 241/5; 241/39; 106/309

[58] Field of Search ..... 44/1 R, 2, 1 SR; 241/5, 241/39

[56] References Cited

U.S. PATENT DOCUMENTS

| | | | |
|---|---|---|---|
| 3,404,120 | 10/1968 | Gotshall | 260/41.5 |
| 3,796,308 | 3/1974 | McIlhinney et al. | 209/9 |
| 3,863,846 | 2/1975 | Keller, Jr. et al. | 241/1 |
| 3,908,920 | 9/1975 | Irons et al. | 241/20 |
| 4,080,176 | 3/1978 | Verschuur | 44/1 SR |
| 4,099,929 | 7/1978 | Tippmer et al. | 44/1 F |
| 4,164,124 | 8/1979 | Taylor et al. | 60/683 |
| 4,192,652 | 3/1980 | Smith | 44/1 SR |
| 4,219,164 | 8/1980 | Taylor | 241/39 X |

*Primary Examiner*—Carl F. Dees

*Attorney, Agent, or Firm*—Dann, Dorfman, Herrell & Skillman

[57] ABSTRACT

A process and apparatus for treating coal to produce micron-size coal particles having high surface reactivity and a low level of ash-forming impurities. The process involves grinding the coal in a substantially air tight fluid energy attrition mill to form a hydrophobic coal-fraction and a hydrophilic impurities-fraction, and separating the fractions by virtue of the impurities-fraction's affinity for water.

22 Claims, 2 Drawing Figures

COAL TREATMENT PROCESS

FIELD OF THE INVENTION

Figure 1:
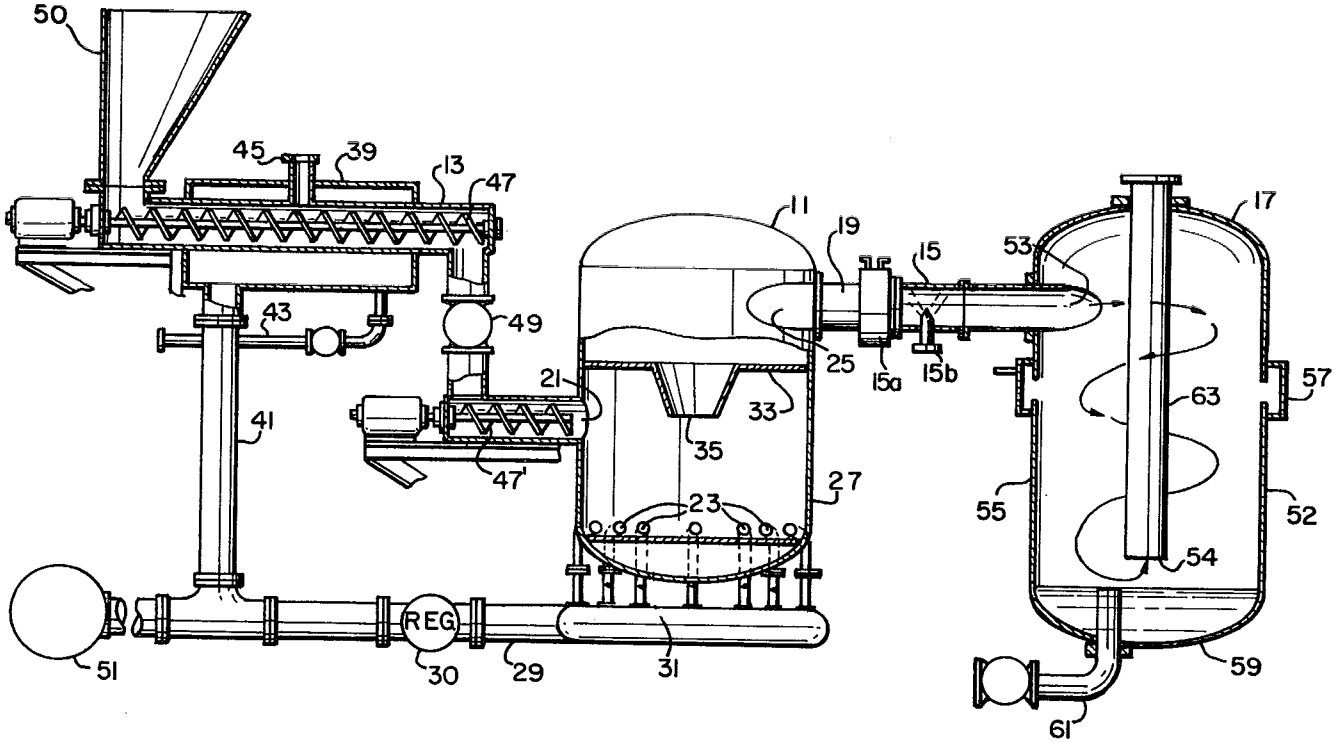

This invention relates to a process for producing a coal product having high surface reactivity and a low level of ash-forming impurities and to apparatus for carrying out such process.

DESCRIPTION OF THE PRIOR ART

It is generally acknowledged that coal possesses untold potential for reducing the dependence of industrialized nations on crude oil as a source of energy. However, this potential has been unrealized for the most part even in the face of steadily escalating crude oil prices. One of the main barriers to the emergence of coal as a prime energy source is the inability of available coal processing techniques to produce an environmentally acceptable coal product. Much of the coal that is currently being mined and is in mineable reserve contains high levels of non-combustible ash-forming impurities, including various minerals such as clays, carbonates, quartz, biotite, rutile, feldspars, hemetite, sulfides and sulfates.

Numerous techniques have been developed for the treatment of coal to remove these impurities, and thereby enhance its acceptability as a fuel. These techniques typically involve coal washeries at the mine site where only surface impurities are removed from relatively large size fractions of the coal and subsequent user treatment by fine grinding in air-swept mechanical mills and thereafter separating the coal particles from the impurities by means of wet cyclones, floatation systems, leaching, dissolution or similar separation means.

Despite the fact that it has been finely divided, the coal produced by such techniques has been found to contain intolerably high levels of impurities, which contribute to environmental pollution because of the ash which is formed when the coal is burned.

Finely divided coal has also assumed increasing importance as a chemical feed stock, e.g. in the production of fuel gas and liquid hydrocarbons. However, when the above-described prior art procedures have been used to produce a feed stock for chemical processing, the product has been found to have only moderate surface reactivity, which results in slow or incomplete reactions. Moreover, it is extremely difficult and very costly to remove the impurities from the product streams. Further, the impurities, which, as indicated above, remain in the coal at significant levels, may contaminate other chemical systems components with which the coal comes in contact, when used as a pigment or filler, for example, and generally have an undesirable effect on the product produced.

Because of the shortcomings outlined above, most of the prior art coal treatment technique have proved not to be commercially useful. Recently, a coal treatment process has been developed wherein the coal is first pulverized in an air-swept mechanical mill to the extent that 70% of the particulate matter passes through a 200 mesh screen, and is thereafter treated with a small amount of oil which adheres preferentially to the coal particles rather than the ash-forming impurities particles produced during the milling process. The oil treatment renders the coal particles hydrophobic, but does not affect the natural hydrophilic characteristic of the ash-forming impurities. Subsequently, the particulate matter undergoes a aqueous treatment in which the coal agglomerates in a float component and the ash is removed in an underflow.

Although the process just described is reportedly capable of removing large percentages of ash-forming impurities from coal treated in accordance therewith, certain problems inhere in its operation. For example, the coal is not sufficiently reduced in size, so that significant portions of ash-forming impurities remain entrapped therein. Also, the coal must be treated with oil to render it hydrophobic, which increases the expense of the apparatus and materials used in carrying out the process. Further, the coal product produced by that process may not be suitable for further processing because the oil treatment contaminates and further diminishes the surface reactivity of the coal.

A coal treatment process and apparatus which overcomes the aforementioned problems in existing techniques would go a long way toward making coal a commercially feasible alternate to crude oil as an energy source, and fostering the use of coal as a chemical feed stock.

SUMMARY OF THE INVENTION

It has now been discovered, in accordance with the present invention, that the milling of coal to a particle size of less than about 40 microns in a substantially air tight fluid energy attrition mill from which air is excluded transforms the coal into a new product having very desirable characteristics. Specifically, the coal product thus produced possesses marked surface reactivity and has been found to be extremely hydrophobic. By contrast, the ash-forming impurities particles, which are generated during milling, retain their innate hydrophilic characteristics. This difference between the coal-fraction and impurities-fraction in their affinity for water makes it possible to separate the two fractions without the use of extraneous chemical agents, such as oil, for imparting hydrophobicity to the coal. The coal product retains the characteristics of high surface reactivity and hydrophobicity even after it is recovered from the apparatus used to produce it, and is again exposed to air.

The process is preferably carried out in a fluid energy attrition mill driven by superheated steam. The steam performs a dual function in that it causes size reduction of the coal particles by effecting impacts therebetween and acts as a carrier medium which transports the micron size coal product from the mill to a suitable separator.

The coal-fraction, impurities-fraction and steam carrier medium are cooled down upon discharge from the mill. Cooling of the mill effluent may be accomplished by heat exchange, either directly by wetting with a small amount of aqueous liquid or indirectly by use of a cooling jacket or condenser. After having been subjected to elevated temperatures and becoming partially dehydrated, the ash-forming impurities, when cooled, provide nucleation sites for condensation of water vapor. Accordingly, water adheres to the ash-forming impurities particles, which then have a tendency to agglomerate, thereby enhancing their separability from the coal particles. Unlike the ash-forming impurities particles, contact with water does not wet the coal particles because of the hydrophobic characteristics imparted thereto by grinding in the absence of air.

Separation is preferably carried out in a water-wall separator. The use of steam as a carrier medium in the process lends itself to such an aqueous separation of the coal and impurities particles.

The coal particles are recovered in a finely divided state (<40 microns), substantially free from impurities. Moreover, the coal is uncontaminated and highly surface reactive. It can thus be seen that the present invention is capable of producing a coal product having highly desirable characteristics more economically than by processes and apparatus heretofore available. Moreover, further economies are achievable as a result of the present invention by reducing the equipment, e.g. gas scrubbers, electrostatic precipitators, etc. required for further processing and/or combustion of the coal product produced thereby.

In essence, the coal treatment process of the present invention involves grinding coal to a particle size of less than about 40 microns in a fluid energy attrition mill from which air is excluded to form a hydrophobic coal-fraction and a hydrophilic impurities-fraction. Next, the coal-fraction and impurities-fraction are contacted with an aqueous liquid whereby the particles constituting impurities-fraction are wetted, but the particles constituting the coal-fraction remain substantially dry. Thereafter the wetted impurities-fraction is separated from the coal-fraction. The description of the coal fraction particles as "substantially dry" is intended to signify that the particles have no measurable amount of water associated therewith.

Preferably, the coal is deaerated prior to its introduction into the mill. It has been found that the greater the extent to which air is excluded from the mill, the greater will be the surface reactivity and hydrophobicity imparted to the coal product of the present invention. Although the principle underlying the present invention is not completely understood, it is believed that the superior surface reactivity and hydrophobicity of the micron size coal product of the present invention, as compared with similar products produced heretofore, is attributable to grinding the coal in an air-free atmosphere. It is thought that very short-lived, high-temperature conditions are experienced on the surfaces of colliding particles so that oxygen will react with the coal, deactivate free radicals and consume hydrogen produced when the carbon reacts with steam to produce atomic hydrogen which would otherwise unite with the unsaturated coal structure to increase its hydrophobicity.

It is believed that when air is excluded from the mill and a water vapor molecule is caught in a collision between two coal particles, oxygen atoms present in the steam become associated with carbon atoms of the coal particles and the hydrogen atoms, associated with, but widely separated from each other by the oxygen atoms in steam are increasingly attracted to neighboring carbons with the end result that one carbon atom will unite with an oxygen and two other carbons will unite with the hydrogens, carbon monoxide being removed in the gaseous state and the hydrogenated carbons remaining as part of the molecular structure of the surface of the coal particle. By this mechanism a hydrogen enrichment of the coal particle surfaces may be effected.

Nitrogen present in the air is believed to have an inhibiting effect on the surface reactivity and hydrophobicity of the coal product produced hereby.

One unit of the apparatus employed in practicing the coal treatment process of the present invention may be described generally as a substantially air tight grinding mill for reducing the coal to particles comprising a hydrophobic coal-fraction and a hydrophilic impurities-fraction, the predominant size of the particles in both fractions being less than about 40 microns. The mill has means for the introduction of an air-free fluid carrier medium, a feed conduit for supplying coal to the mill for size reduction and entrainment in the air-free carrier medium, the conduit having means to exclude air therefrom as well as from the mill, and outlet means for withdrawing from the mill at least a portion of the coal-fraction and impurities-fraction entrained in the carrier medium. Means are provided for cooling the coal-fraction and impurities-fraction withdrawin from the mill, thereby causing wetting of the particles constituting the impurities-fraction, but leaving the particles constituting the coal-fraction in a substantially dry, hydrophobic condition. The apparatus also includes a separator for separating the coal-fraction from the impurities-fraction, as well as means for transferring the carrier medium with the aforesaid fractions entrained therein from the mill to the separator.

It can thus be seen that the present invention provides a coal treatment process and apparatus capable of producing a hydrophobic coal-fraction and a hydrophilic ash-forming impurities-fraction, which fractions may be selectively separated one from the other.

There is also provided in accordance with the present invention a coal treatment process and apparatus capable of producing a micron size coal product substantially freed from ash-forming impurities.

The present invention further provides a coal treatment process and apparatus capable of producing a coal product which is uncontaminated by chemical agents and is highly surface-reactive.

The present invention also provides a coal treatment process and apparatus capable of continuous operation.

Figure 2:
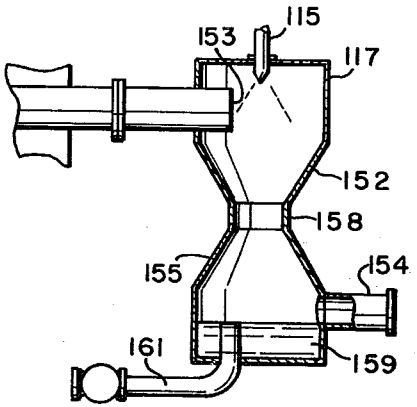

The novel features and advantages of the present invention will become apparent from the following description thereof read in conjunction with the accompanying drawing, in which:

FIG. 1 is a diagrammatic elevation in section showing a presently-preferred embodiment of the coal treatment apparatus of the invention; and FIG. 2 is a diagrammatic elevation in section showing an alternate form of separator which may be used in practicing the invention.

Referring now to the drawings, FIG. 1 shows a coal treatment apparatus comprising, in combination, a coal grinding mill 11, feed conduit 13, means 15 for cooling the effluent from the mill, separator 17, and means, such as duct 19, for transferring the mill effluent to the separator.

The grinding mill, which is substantially air tight, reduces the coal to particles comprising a coal-fraction and an impurities-fraction, a major portion of the particles having a size of less than about 40 microns. The mill is provided with an inlet 21, for introducing raw, untreated coal into the mill, means, such as ejector nozzles 23, for introducing an air-free fluid carrier medium into the mill, and an outlet 25 for withdrawing from the mill the coal-fraction and impurities-fraction, which are entrained in the carrier medium.

The preferred grinding mill for practicing this invention is a fluid energy attrition mill of the type disclosed in my co-pending application Ser. No. 21,061, filed Mar. 16, 1979, now U.S. Pat. No. 4,219,164, entitled "Comminution of Pulverulent Material By Fluid Energy", the entire disclosure of which is incorporated herein by reference. Briefly, the mill disclosed in U.S. Pat. No. 4,219,164 comprises a generally upright cylindrical pressure vessel 27, as shown in FIG. 1, having a grinding zone at one end and outlet 25 at the other, a generally cylindrical core zone having an axis disposed generally centrally within the vessel between the grinding zone and the outlet means, and an annular peripheral zone surrounding the core zone, with the ejector nozzles 23 being arranged circumferentially for injecting an air-free fluid carrier medium into the grinding zone. The carrier medium is delivered to the ejector nozzles via inlet pipe 29 and external manifold 31. The rate of delivery of the steam may be controlled by any suitable regulating means, such as regulator 30.

The fluid carrier medium, which is preferably superheated steam, is injected in a direction between a radius to the core zone axis and a line perpendicular thereto. All of the nozzles 23 are disposed at an inclined angle in the grinding zone to inject a primary flow of fluid carrier medium into the vessel through said grinding zone so as to generate an axially-flowing vortex within the core zone. The vessel also has transverse partition means 33 at the outlet end spaced from the grinding zone to intercept the axially-flowing vortex and deflect at least a first portion of the medium therein outwardly into the peripheral zone, the fluid medium deflected into the peripheral zone flowing oppositely as a secondary flow into the primary flow issuing from the nozzles 23 to thereby effect a recirculation of the fluid carrier medium within the vessel. Partition 33 has a central opening 35 therein which is positioned at the upper end of the vortex and permits withdrawal from the mill of a second portion of the fluid medium and with it at least a portion of the coal-fraction and impurities-fraction, which are discharged from the vessel through outlet 25.

In order to optimize the surface reactivity and hydrophobicity of the coal product of the present invention, the coal should be deaerated prior to its introduction into the mill. To this end, feed conduit 13 is provided with means for excluding air from the conduit and from the untreated coal passing therethrough before entering the mill. Such means may include jacket 39 containing a fluid heating medium which surrounds feed conduit 13 for effecting indirect heat transfer to the coal in the feed conduit. The jacket may be provided with a heating medium supply duct 41 and a discharge duct 43 for recirculating the heating medium therethrough. Vent means 45 is provided on the feed conduit 13 to expel water vapor and air driven off from the feed coal as a result of heat exchange between the heating medium and the coal in the feed conduit.

The feed conduit 13 may be provided with mechanical air-lock means, such as a screw auger 47, for advancing the untreated coal through the conduit. The amount of coal that is fed into the mill may be regulated by rotary seal valve 49. The coal may be delivered through valve 49 directly into the mill, or an additional screw auger 47' may be provided to advance the coal into the mill. A hopper 50 is ordinarily associated with feed conduit 13 to hold a supply of pre-crushed coal ($\frac{1}{4}'' \times 0$) in readiness for introduction into the mill.

The fluid heating medium for heating the feed coal and the air-free fluid carrier medium introduced into the grinding mill may originate from a common supply which is preferably a source of steam, such as boiler 51.

After size reduction is accomplished in the mill, transfer duct 19 carries the coal and impurities fractions entrained in the carrier medium to separator 17. Before the coal and impurities particles and the carrier medium enter the separator, they pass through the cooling means 15 where the particles come in contact with an aqueous liquid to cause wetting of the hydrophilic impurities particles, while the hydrophobic coal particles remain substantially dry.

When steam is employed as the carrier medium, the means for cooling the coal and impurities particles may take the form of a condenser or indirect heat exchanger **15*a* disposed within, or surrounding transfer duct 19, the cooled impurities particles providing nucleation sites for condensation of the steam. In this instance, cooling means 15 reduces the temperature of the particle-laden carrier medium below the dew point of the carrier steam, thereby intiating the wetting operation. However, transfer duct 19 preferably includes a spray nozzle 15*b*** for cooling the steam by direct heat exchange and providing a small amount of condensed water which nucleates on the impurities fraction but not on the coal fraction as the fractions pass therethrough. The wetted impurities particles tend to agglomerate becoming more massive than the particles constituting the coal fraction, and this mass differential enhances the separability of the impurities-fraction from the coal-fraction.

The preferred device for separating the coal-fraction from the impurities-fraction is a separator of the type illustrated in FIG. 1. Separator 17 comprises a vessel 52 having an inlet 53, a discharge 54 and wall means 55 disposed between said inlet and discharge defining an annular separation zone. The separator is provided with means, such as a weir 57, for wetting the wall means with an aqueous layer.

It should be noted that when steam is employed as the carrier medium, the water in the vicinity of the upper portion of vessel 52 near inlet 53 may serve to effect condensation of the steam, on the impurities particles thus obviating a separate cooling device. Similarly, the upper portion of the vessel may be provided with cooling means, such as a heat exchanger (not shown) which is capable of producing copious amounts of water in the upper reaches of the separation vessel, thereby providing an aqueous fluid which wets the annular wall means, thus making weir 57 unnecessary.

The impurities-fraction particles and coal-fraction particles, entrained in the carrier medium, are delivered into the separation zone on a tangential path and flow in a helical path downwardly through the separation zone, as indicated by the arrow in FIG. 1, thereby exerting a centrifugal force on the particles, thrusting them to the wall of vessel 52. The aqueous layer retains at least a portion of the impurities-fraction coming in contact therewith and the impurities-laden aqueous liquid is collected, e.g. in sump 59, and removed from the separator through take-off pipe 61. Due to their hydrophobicity, the particles constituting the coal fraction do not become associated with the water, but spiral downwardly within the separation zone and are withdrawn along with the carrier medium through the discharge. As shown in FIG. 1 discharge 54 is preferably positioned at one end of a tubular duct 63 which extends axially into the separation zone from the inlet of the separation vessel.

The separator may be as large as practical so at to lengthen the particle path and increase the residence time of the particles therein.

Separation of the coal-fraction from the impurities-fraction may be carried out in a Venturi separator of the type shown in FIG. 2, rather than in the above-described water-wall separator. As shown in FIG. 2, separator 117 comprises a vessel 152 having an inlet 153, a discharge 154 and annular wall means 155, the central portion 158 of which is constricted to accelerate and impart force to the carrier medium-entrained coal and impurities particles passing therethrough. The fractions are cooled upon entering vessel 152 through inlet 153 by spray nozzle 115, causing wetting of the impurities particles as described above. Nozzle 115 projects a divergent spray, forming a layer of aqueous fluid that flows down the inner surface of wall means 155 and retains at least a portion of the impurities-fraction coming in contact therewith. The remaining heavier agglomerated impurities-fraction is impelled into the bath or sump 159 at the bottom of the chamber. The aqueous liquid carrier and retained impurities are collected in the sump 159 at the outlet end of the separator and are discharged or drained as indicated at 161. The coal product is recovered from the Venturi separator through discharge 154.

In both of the separators described herein the continuous flow of water retards accumulation of particulate material on the vessel walls.

The process of the present invention is preferably carried out by employing the apparatus of FIG. 1 in accordance with the following general description.

Coal is crushed to about $\frac{1}{4}''$ and fed to the superheated steam driven fluid energy mill 11 via feed conduit 13 in which the coal is heated indirectly by steam circulating through jacket 39. The indirect heat exchange effected in this manner between the steam and the coal evaporates moisture associated with the coal, thus producing water vapor which escapes through vent 45 taking with it any air entrained in the feed coal. The deaerated coal is reduced to particles comprising a coal-fraction and an impurities-fraction by the action of sonic velocity superheated steam jets introduced through ejector nozzles 23. Micron size coal and ash-forming impurities particles of a top size of from about 40 to about 15 microns are exhausted from the mill entrained in spent steam. The coal particles are hydrophobic, porous and highly surface reactive and the ash-forming impurities particles are hydrophilic and partially dehydrated. Water is sprayed into the two fractions upon discharge from the mill by spray nozzle **15*b* to reduce the temperature of the steam to about 220° F. and to provide a small amount of condensed water which nucleates on the hydrophilic impurities particles but not on the hydrophobic coal particles. Both fractions are transferred to the water-wall separator vessel 52 wherein the impurities particles are captured in the water at the outer periphery of the zone, and collected in a slurry in sump 59**. The remaining steam with the coal fraction entrained therein is exhausted through the separator's discharge to downstream processes substantially free of ash-forming impurities.

The saturated steam carrying the coal product from the apparatus may be superheated again by the injection of a slight amount of more highly superheated process steam, thus preventing condensation in piping and downstream equipment. The same result may be achieved by imposing a back pressure on the separator to effect condensation at a higher pressure, and expanding the steam to a slightly superheated condition following the separation step.

The coal product produced by this process is very surface reactive due to molecular fragmentation in the absence of air, and is useful either as a combustion fuel feed or as a chemically active feedstock.

The presently preferred specific parameters set forth hereinbelow may be suitable for practicing the present invention.

Forty thousand pounds of pre-crushed coal ($\frac{1}{4}''\times 0$) containing 14% moisture, and 12% ash-forming impurities is fed into hopper 50 at 60° F. Steam at 700° F./450 psia is supplied by boiler 51. A portion of the supply steam is introduced into drier steam jacket via supply duct 41. The moisture content of the coal may be reduced by 10% or 4,000 pounds of moisture per hour, which may be evaporated and vented with air entrained in the coal feed through vent 45. Under these conditions, it is expected that thirty-six thousand pounds of coal per hour containing 1,600 pounds of unevaporated moisture will be fed into mill 11 through inlet 21 at a temperature of 220° F. Hence, five thousand twenty four pounds per hour of high pressure steam will be condensed in the drier and returned to boiler 51 by pump 44.

Steam for the mill 11 will be throttled from 450 psia to 200 psia through regulating means 30 in supply line 29 and steam conditions at the ejector nozzles 23 should then be 670° F./200 psia. 27,000 pounds per hour of steam will be expanded through the nozzles and is expected to process the coal to a $20\mu\times 0$ product which may be exhausted through outlet 25 at 305° F. comprising 30,400 pounds of completely dehydrated coal, 4,800 pounds of ash-forming impurities and 28,600 pounds of steam. The exhausted mixture will next traverse spray nozzle 15 wherein water at 60° F. will be sprayed from a source (not shown) at a rate of 10,000 pounds per hour which is anticipated to result in a mill effluent flow which contains, on a per hour basis, 30,400 pounds of coal, 4,800 pounds of ash-forming impurities, 28,757 pounds of steam at 220° F. and 9,843 pounds of water. The coal and impurities fractions will thereafter be introduced via inlet 53 on a tangential path into separator vessel 52 to produce a coal product which should contain as little as $\frac{1}{2}$% to 5% of ash-forming impurities depending upon the nature and amount of impurities in the raw coal.

While a presently preferred embodiment of the invention has been illustrated and described herein, it is not intended to limit the invention to such disclosure, but changes and/or additions may be made therein and thereto without departing from the invention as set forth in the following claims. For example, a grinding mill other than the steam-driven fluid energy mill described hereinabove may be employed in practicing the invention, so long as the mill is capable of producing micron size coal and impurities particles in the absence of air. Likewise, other separators which are capable of classifying solid particles on the basis of their affirmity for, or attraction by water may be employed instead of the water-wall and Venturi separators described hereinabove.

I claim:

1. An apparatus for treating coal to reduce the level of ash-forming impurities contained therein comprising, in combination:

a substantially air tight grinding mill for reducing said coal to particles comprising a hydrophobic coal-fraction and a hydrophilic impurities-fractions, a major portion of said particles having a size less than about 40 microns, injector means for introducing an air-free fluid carrier medium into said mill, inlet means for introducing raw coal into said carrier medium, and outlet means for withdrawing from said mill at least a portion of said coal-fraction and impurities-fraction entrained in said carrier medium;

a feed conduit for supplying raw coal to said mill for size reduction said conduit having means for excluding air from said conduit and said mill;

means for cooling said withdrawn coal-fraction and impurities-fraction thereby causing wetting of the particles constituting the impurities fraction, but leaving the particles constituting the coal-fraction substantially dry;

a separator for separating said hydrophobic coal-fraction from said wetted impurities-fraction; and means for transferring said carrier medium with said unagglomerated coal-fraction and said impurities-fraction entrained therein from said mill to said separator.

2. An apparatus according to claim 1 wherein said grinding mill is a fluid energy attrition mill comprising a vessel having a grinding zone at one end, said outlet means at the other and a generally cylindrical core zone having an axis disposed generally centrally within said vessel between said grinding zone and said outlet means and an annular peripheral zone surrounding said generally cylindrical core zone, a plurality of circumferentially-spaced ejector nozzles for injecting said air-free fluid carrier medium into said grinding zone in a direction between a radius to said core zone axis and a direction perpendicular to said radius, all of said nozzles being disposed at an inclined angle in said grinding zone to inject a primary flow of fluid carrier medium into said vessel through said grinding zone so as to generate an axially-flowing vortex within said central zone, said vessel having transverse wall means at the other end spaced from said grinding zone to intercept the axially-flowing vortex and deflect at least a first portion of the medium therein outwardly into said annular peripheral zone, the fluid medium deflected into said peripheral zone flowing oppositely as a secondary flow into said primary flow issuing from said nozzles to thereby effect a recirculation of the fluid carrier medium within said vessel, said outlet means at the remote end of said vortex operable to withdraw from said mill a second portion of said fluid medium and with it at least a portion of the coal-fraction and impurities-fraction.

3. An apparatus according to claim 1 wherein said separator comprises a vessel having an inlet, a discharge, and wall means disposed between said inlet and discharge defining an annular separation zone, said inlet delivering said substantially dry coalfraction particles and said wetted impurities-fraction particles entrained in said carrier medium into said separation zone, means for generating a centrifugal force in said carrier medium and fractions within said separation zone, means for wettingsaid annular wall means with an aqueous layer, said aqueous layer retaining at least a portion of the impurities-fraction coming in contact therewith, means for collecting and discharging the impurities-fraction laden aqueous layer, and exhaust means operative to withdraw said carrier medium with at least a portion of said coal fraction through said outlet means of said separator.

4. An apparatus according to claim 3 wherein said discharge comprises a tubular duct extending axially into said separation zone from the inlet of said separating vessel.

5. An apparatus according to claim 1 wherein said feed conduit comprises mechanical means for advancing raw coal therethrough.

6. An apparatus according to claim 4 wherein said mechanical advancing means is a screw auger.

7. An apparatus according to claim 1 wherein said feed conduit includes heating and deaerating means comprising a jacket surrounding said feed conduit, said jacket being adapted for the circulation of a fluid heating medium therethrough to effect indirect heat exchange between said heating medium and the raw coal passing through said feed conduit.

8. An apparatus according to claim 7 wherein said heating and deaerating means comprises a vent disposed in said feed conduit and responsive to the accumulation of vapor generated within said feed conduit by said fluid heating medium.

9. An apparatus according to claim 1 wherein said transferring means constitutes a conduit interconnecting said outlet means of said mill and said inlet of said separator.

10. An apparatus according to claim 1 wherein said cooling means comprises a spray of water for effecting direct heat exchange with the mill effluent.

11. An apparatus according to claim 2 including a common supply for said fluid heating medium and said fluid carrier medium.

12. An apparatus according to claim 11 wherein said common supply of said heating medium and said fluid carrier medium is a source of steam.

13. An apparatus according to claim 1 wherein the fluid carrier medium is steam.

14. An apparatus according to claim 13 including means effecting condensation of the carrier steam following its withdrawal from said grinding mill to produce an aqueous fluid which wets said annular wall means.

15. A process for treating coal to reduce the level of ash-forming impurities contained therein comprising:

a. grinding raw coal to a particle size of less than about 40 microns in a substantially air free environment to form a hydrophobic coal fraction and a hydrophilic impurities fraction;

b. contacting said fractions with an aqueous liquid whereby the particles constituting the impurities fraction are wetted, but the particles constituting the coal fraction are left substantially dry;

c. separating the impurities particles from the coal particles.

16. A process for treating coal to reduce the level of ash-forming impurities contained therein comprising:

a. deaerating raw coal;

b. grinding said coal to a particle size of less than about 40 microns in a substantially air free environment to form a hydrophobic coal-fraction and a hydrophilic impurities-fraction;

c. contacting said fraction with an aqueous liquid whereby the particles constituting the impurities-fraction are wetted but the particles constituting the coal fraction are left substantially unagglomerated;

d. separating the impurities particles from the coal particles.

17. A process for beneficiating coal to reduce the level of ash-forming impurities contained therein comprising:

a. heating raw coal to reduce the moisture content thereof;
b. deaerating said coal;
c. grinding said coal to a particle size of less than about 40 microns in a substantially air free environment to form a hydrophobic coal-fraction and a hydrophilic impurities-fraction;
d. contacting said fractions with an aqueous liquid whereby the particles constituting the impurities fraction are wetted but the particles constituting the coal fraction are left substantially dry;
e. separating the impurities particles from the coal particles; and
f. recovering the separated coal particles.

18. The process according to claims 15, 16, or 17 wherein said separating step is carried out in a separation vessel having an inlet, a discharge, and wall means disposed between said inlet and said discharge defining a separation zone, said separation zone being surrounded at its outer periphery by a aqueous separation medium, and comprises subjecting said fractions to centrifugal force in said separation zone, collecting a substantial portion of the impurities-fraction in said aqueous medium, and exhausting the coal fraction from the interior of said separation zone through said discharge.

19. The process according to claims 15, 16, or 17 wherein said separating step is carried out in a separation vessel having an inlet, a discharge, and wall means disposed between said inlet and said discharge defining a separation zone, said separation zone having an aqueous separation medium adjacent said discharge and comprises introducing said fractions through said inlet into said separation zone, accelerating said fractions through said separation zone, collecting a substantial portion of the impurities-fraction in said aqueous medium, and exhausting the coal fraction from said separation zone through said discharge.

20. The process according to claim 17 wherein heating and deaerating of the coal are carried out simultaneously.

21. The process according to claims 15, 16, 17, or 20 wherein the steps of said process are carried out continuously.

22. The product produced according to the process of claims 15, 16, 17, or 20.

* * * * *